US009004420B2

(12) United States Patent
Oltman

(10) Patent No.: US 9,004,420 B2
(45) Date of Patent: Apr. 14, 2015

(54) INTERLOCKING SUPPORT FOOT

(71) Applicant: Snyder Industries, Inc., Lincoln, NE (US)

(72) Inventor: Darrell A. Oltman, Lincoln, NE (US)

(73) Assignee: Snyder Industries, Inc., Lincoln, NE (US)

( * ) Notice: Subject to any disclaimer, the term of this patent is extended or adjusted under 35 U.S.C. 154(b) by 0 days.

(21) Appl. No.: 13/801,657

(22) Filed: Mar. 13, 2013

(65) Prior Publication Data

US 2014/0263885 A1 Sep. 18, 2014

(51) Int. Cl.
*A47B 91/02* (2006.01)
*F16M 11/24* (2006.01)
*B65D 25/04* (2006.01)

(52) U.S. Cl.
CPC ..... *B65D 25/04* (2013.01)

(58) Field of Classification Search
CPC ..... F16M 7/00; F16M 11/00; F16M 13/00; F16M 2200/00; D06F 39/125; A47B 13/06; A47B 91/02; A47B 91/022; A47B 91/206; A47B 91/028; A47B 2220/003; B65D 25/24; B65D 19/40; B65D 19/0097; B65D 2519/00338; B65D 2519/00497; B65D 2200/00; B65D 2200/08
USPC ..... 248/677, 188.1, 188.4, 188.2, 188.8, 248/188.9, 346.06, 346.01
See application file for complete search history.

(56) References Cited

U.S. PATENT DOCUMENTS

| | | | | | |
|---|---|---|---|---|---|
| 2,292,299 | A * | 8/1942 | Smith | 36/59 R |
| 2,689,417 | A * | 9/1954 | Bernstein | 36/59 R |
| 2,784,503 | A * | 3/1957 | Anderson | 36/59 R |
| 3,722,565 | A * | 3/1973 | Miller et al. | 411/180 |
| 5,524,367 | A * | 6/1996 | Ferreira et al. | 36/134 |
| 5,906,344 | A * | 5/1999 | Atkinson et al. | 248/188.9 |
| 6,484,899 | B1 * | 11/2002 | Garton | 220/630 |
| 7,007,413 | B2 * | 3/2006 | McMullin | 36/134 |
| 7,118,081 | B2 * | 10/2006 | Smith et al. | 248/188.2 |
| 8,531,837 | B2 * | 9/2013 | Lee et al. | 361/679.59 |

* cited by examiner

*Primary Examiner* — Nkeisha Smith
(74) *Attorney, Agent, or Firm* — Hovey Williams LLP

(57) ABSTRACT

An interlocking support foot and a container assembly including the support foot permits the support foot to be threaded onto a container but resists loosening of the foot by reverse rotation of the support foot once installed onto the container. The support foot is preferably molded of synthetic resin as a unitary member including a body, a threaded connector and at least one, and preferably a circular array of teeth radially spaced from the connector. The container is complementally configured to include a plurality of support areas for threadably receiving the support foot and provided with a threaded receiver and a radially spaced notch. When the support foot is installed on the support area of the container, the tooth engages the notch and resists reverse rotation of the foot.

10 Claims, 6 Drawing Sheets

INTERLOCKING SUPPORT FOOT

BACKGROUND OF THE INVENTION

1. Field of the Invention

The present invention concern containers used for holding materials which are supported above the ground by support feet. More particularly, it is concerned with an interlocking support foot adapted for mounting to the bottom of such containers whereby loosening of the support foot is resisted by an interlocking feature, as well as a corresponding method of supporting such a container on support feet.

2. Description of the Prior Art

Containers are often employed to hold materials such as liquids or particulate matter until they are ready to be dispensed for use. Oftentimes it is desirable to elevate the main portion of the container above a floor or other supporting surface for ease of cleaning, for permitting lifting mechanisms such as fork lifts to place their tines beneath for lifting, and for ease of dispensing the contents of the container. In such circumstances, support feet may be coupled to the container.

An example of the use of support feet with a container, in particular a fluid tank, is shown in U.S. Pat. No. 6,484,899, the entire contents of which are incorporated herein by reference. There, a rotationally molded tank includes support columns which include threaded recesses for mounting support feet thereto. The support feet are threaded into the recesses and serve to elevate the container above a supporting surface. The support feet which can be threadably attached is a structural feature which takes the place of a rotationally molded base.

SUMMARY OF THE INVENTION

The present invention provides a significant advance over the assembly shown in the U.S. Pat. No. 6,484,899 in that it provides support feet which resist loosening or, in the extreme, detachment from the container. Loosening of the support feet connection with the container may result in uneven support of the container, which places greater stress on some areas of the container when it is filled. The present invention overcomes this problem by providing structure in the form of one or a plurality of teeth on the support feet which engages a corresponding support area on the tank when the support foot is fully mounted. This engagement prevents loosening of the foot and thus provides a stable support connection between the container and the support foot.

In greater detail, the support foot of the present invention may include a body having an upper surface, a connector which extends upwardly from the upper surface and having a helical thread, and at least one tooth spaced radially outwardly from the connector and projecting upwardly from the upper surface. The connector, the at least one tooth, or preferably both are unitary with the body, and the support foot may be molded of synthetic resin. The helical thread may be an external helical thread, and the body may be circular when viewed in horizontal cross section. The tooth may be provided with an upright end wall and a sloped wall. The sloped wall may be longer than the upright wall, and may extend upwardly from the upper surface to a peak where it intersects with the upright wall. The sloped wall is preferably oriented to extend generally perpendicular to a radial line extending outwardly from the center of the connector, and to incline upwardly from the upper surface to the peak whereby the tooth has progressively greater engagement with the container as the support foot is threaded onto a corresponding support area of the container. In this way, the upright wall of the tooth may engage the container to resist reverse rotation of the support foot which would tend to otherwise loosen it from the container. More preferably, a plurality of such teeth are positioned in a circular array along the upper surface. The array may include a plurality of such teeth, with their slopes in a common circular orientation, and placed end to end. A relatively flat, annular supporting surface may be located between the connector and the array.

The support foot may beneficially be used in combination with a container having one or a plurality of complementally configured support areas. The support areas may be provided with a threaded receiver, for example an internally threaded receiver, complementally configured to threadably receive the helical thread of the connector. The support areas may be unitary with the container, and molded of synthetic resin. The support areas may be provided with at least one notch which extends downwardly from the surrounding portion of the support area. The notch may have an upright surface and a sloped surface oriented so that the sloped wall of the foot support slides over the sloped surface during installation and tightening of the support foot. There may be a plurality of such notches provided in spaced circular arrangement as a locking ring, so that one or more of the teeth may engage one or more of the notches. An annular flat bottom surface may be provided between the array and the threaded receiver and positioned opposite the annular flat support surface of the support foot.

The invention hereof may further include a method of supporting a container on one or more of such support feet. The connector of the support feet may be inserted into a respective one of the threaded receivers, and rotated. This will result in threading of the support foot onto the container, bringing the tooth into engagement with the support area. As a result of the orientation of the sloped wall of the support foot, the support foot will then progressively bring the tooth into further engagement with the support area, and the peak of the tooth will then resist loosening of the support foot on the container's support surface. Preferably, the provision of one or more notches, which have a sloped surface and a downwardly extending upright wall which are opposite the orientation of the corresponding sloped wall and upright wall of the teeth, will result in the upright wall of the teeth being blocked from reverse rotation by the upright surface of the notches. Thus, by tightening the support foot on the support area of the container, the support foot will retain this tightened position. Most preferably, this will also result in the flat annular support surface being in engagement with the opposite flat, annular bottom surface of the container for improved support of the container by the support foot.

DESCRIPTION OF THE PREFERRED EMBODIMENT

Figure 2:
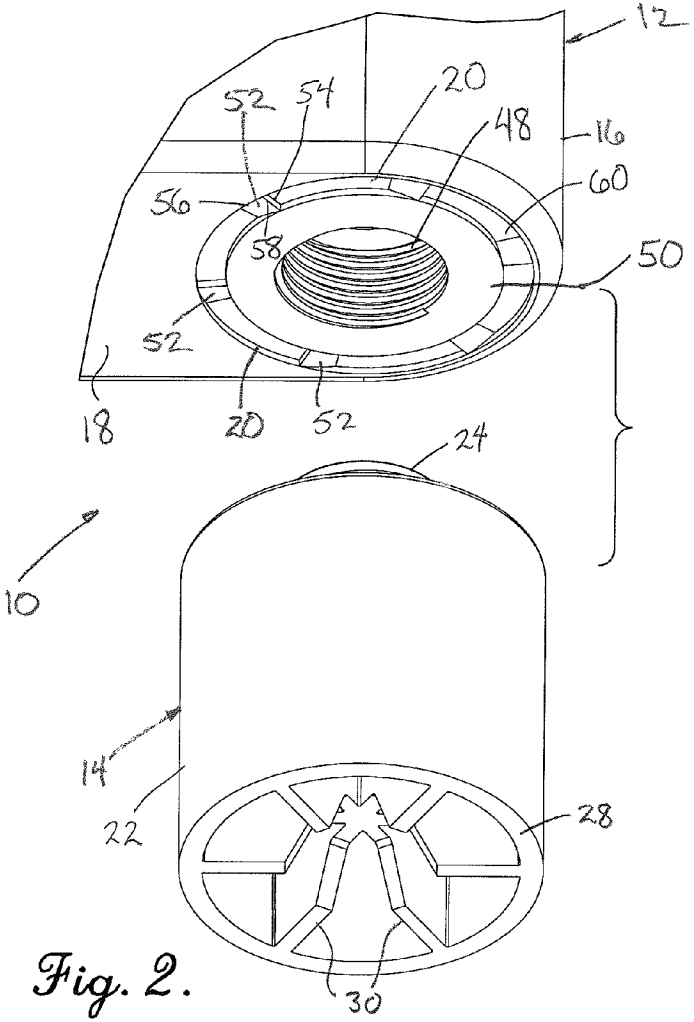
FIG. 2 is an enlarged, fragmentary isometric view showing a support area including a threaded receiver on the bottom of the container and the bottom of one of the support feet showing a plurality of radially oriented intersecting support ribs.

Referring now to the drawing, a container assembly 10 broadly includes a container 12 for holding materials such as liquids or particulate matter and a plurality of support feet 14. As set forth in U.S. Pat. No. 6,484,899, the entire disclosure of which is incorporated herein by reference, the container 12 may be rotationally molded of a synthetic resin material such as high density polyethylene and may have a central tank section and support columns 16 at its corners. The container 12 may be unitary and be provided with a bottom section 18 having support areas 20, the support areas 20 in the preferred embodiment being located at the bottom of the support columns 16.

Figure 1:
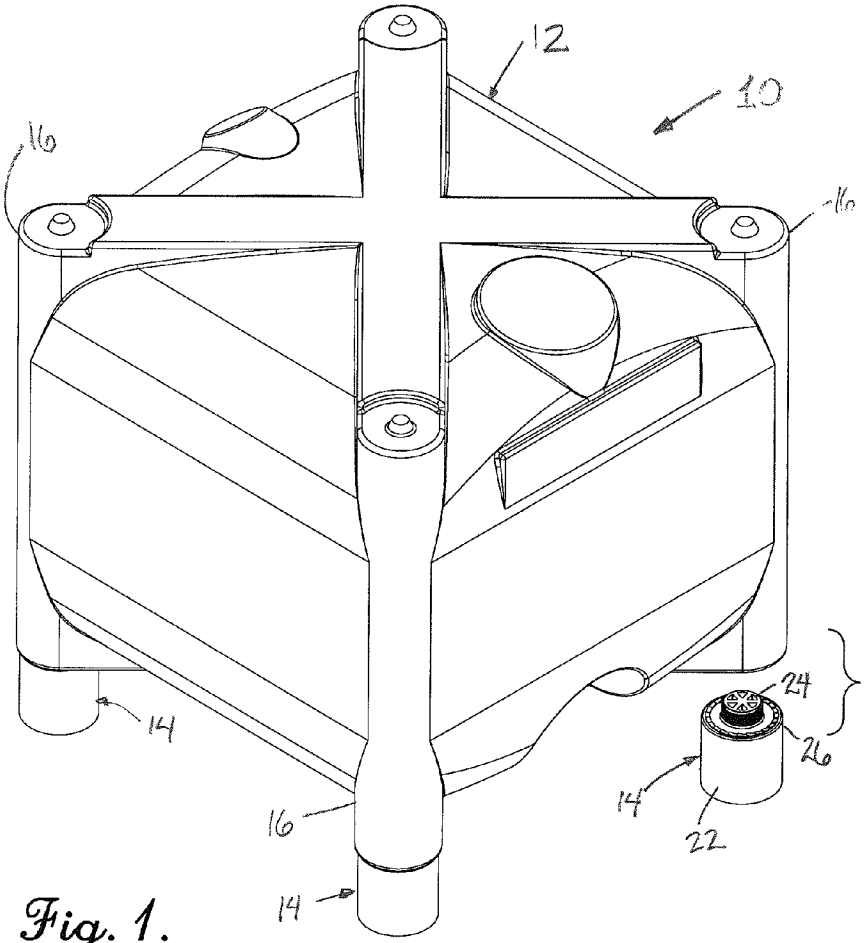
FIG. 1 is an isometric view of a container assembly with a container supported by a plurality of support feet, one of the plurality of support feet being broken away for clarity.
Figure 3:
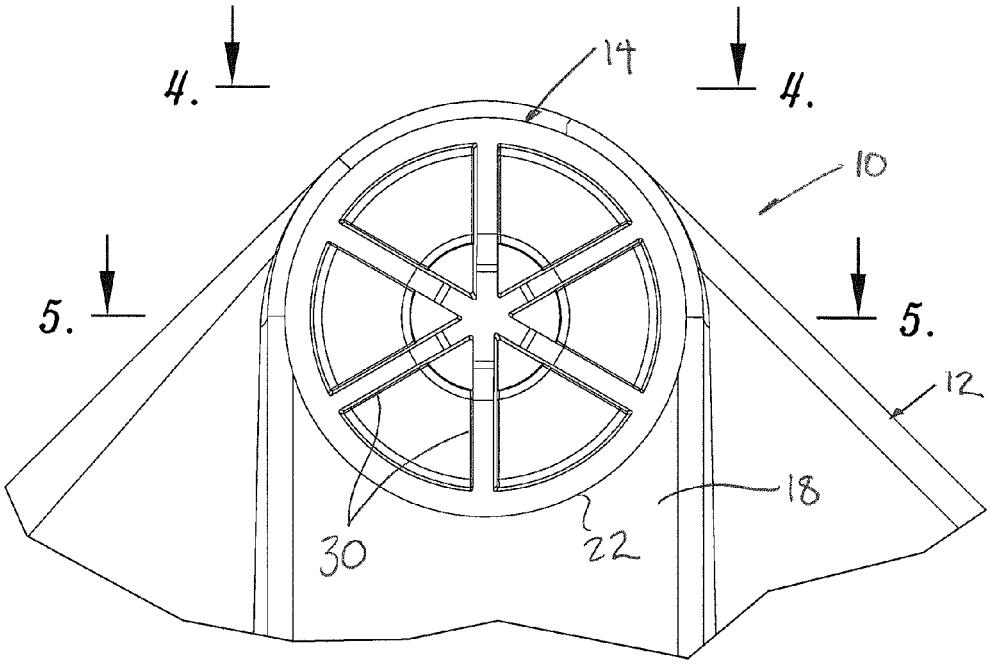
FIG. 3 is an enlarged, fragmentary bottom view of one of the support feet threadably coupled to the container.

The support feet 14 are complementally configured to be coupled with the container 12 as shown in FIGS. 1 and 2. The support feet 14 include a body 22, a connector 24 and at least one and preferably a plurality of teeth 26. The support feet 14 are preferably molded of a synthetic resin such as high density polyethylene and the body 22, connector 24 and teeth 26 are unitary.

Figure 8:
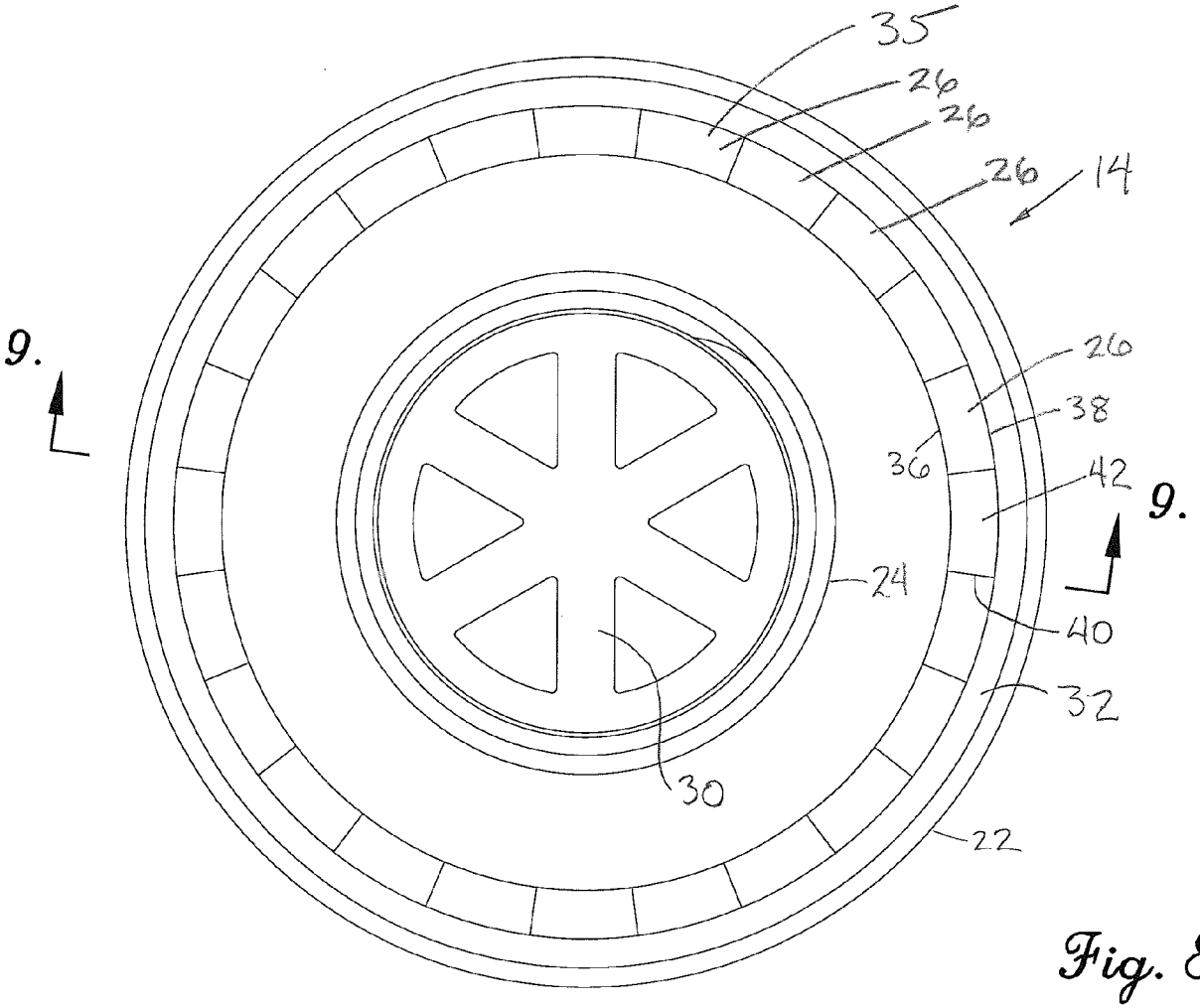
FIG. 8 is an enlarged plan view of the connector showing the positioning of the flat, annular supporting surface between the array of teeth and the connector.
Figure 9:
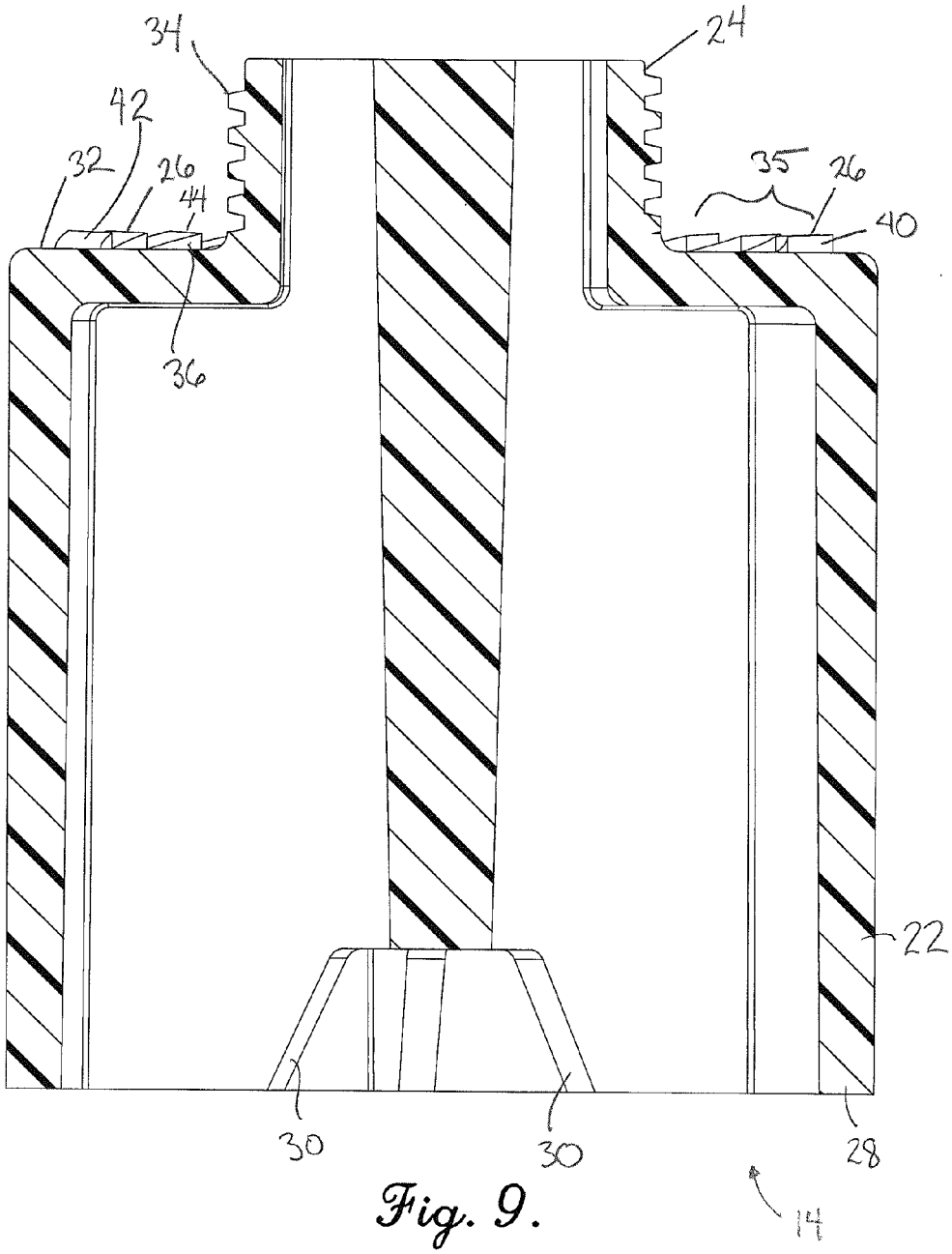
FIG. 9 is an enlarged vertical cross-sectional view of a support foot taken along line 9-9 of FIG. 8 showing the sloped wall and upright end wall of the teeth of the array.

In greater detail, the body 22 may have an outer wall 28, the exterior of which is circular when viewed in plan and be provided with a plurality of interior, radially inwardly oriented intersecting ribs 30. Other wall configurations may be utilized and thus it may be appreciated that the body 22 could be polygonal (e.g., square) or of other configurations when viewed in plan. The ribs 30 provide a web-like interior structure reinforcement and support and lessen the quantity of material required for the support feet 14. The ribs 30 preferably extend upwardly through the body 22 and extend into the interior of the connector 24 as shown in FIGS. 8 and 9. The body also includes an upper surface 32.

Figure 6:
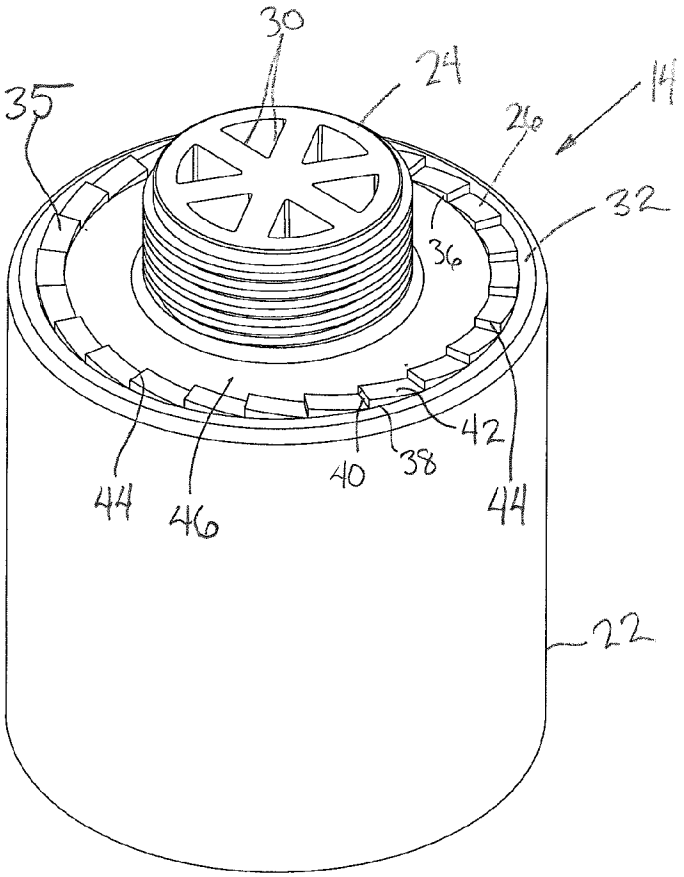
FIG. 6 is an enlarged upper isometric view of a support foot showing the connector and the teeth of the array in end-to-end circular orientation.

The connector 24 extends upwardly from the upper surface 32. Preferably, the connector 24 is generally cylindrical in shape and provided with an external helical thread 34. The thread 34 is most preferably a fine thread with a small pitch, such that an increased number of thread surfaces engage the support area 20 of the container 12. As illustrated in FIG. 6, the helical thread 34 is shown as a right-handed thread whereby rotating the support foot 14 in a clockwise direction threads the connector 24 onto the support area 20.

At least one, and preferably a plurality of teeth 26 are spaced radially outwardly of the connector 24 on the upper surface 32 of the support foot 14. The teeth 26 extend upwardly from the upper surface. Most preferably, the teeth 26 are provided in an array 35 extending in a circular pattern surrounding the connector 24 as shown in FIGS. 6 and 8. Each tooth 26 may be provided with an upright inner wall 36, and upright outer wall 38, an upright end wall 40 and a sloped wall 42. The upright end wall 40 and the sloped wall 42 converge at a peak 44. The sloped wall 42 is preferably oriented to be opposite in slope relative to the helical thread 34. Thus, the sloped wall extends upwardly from the upper surface 32 to the peak 44 in the direction of rotation of the support foot 14 as it is threaded onto the support area 20, as seen most clearly in FIGS. 4 and 6. For each tooth 26, the longitudinal extent of the sloped wall 42 is generally perpendicular to a radial line extending outwardly from the center of the connector 24. In the same way, the upright end wall 40 extends generally perpendicular to the upper surface 32 and generally in an upright plane extending radially from the center of the connector 24. Most preferably, the teeth 26 in the array 35 are positioned end-to-end and are commonly oriented so that each sloped wall 42 extends from the peak 44 downwardly to the upper surface 32 in the direction of rotation corresponding to the threaded installation of the support foot 14 onto the container 12. Most preferably, an annular, substantially flat support surface 46 is provided on the upper surface 32 and is preferably in a substantially horizontal plane in normal use. The flat, annular support surface 46 is preferably positioned between the connector 24 and the teeth 26, and thus radially intermediate the connector 24 and the array 35.

Figure 4:
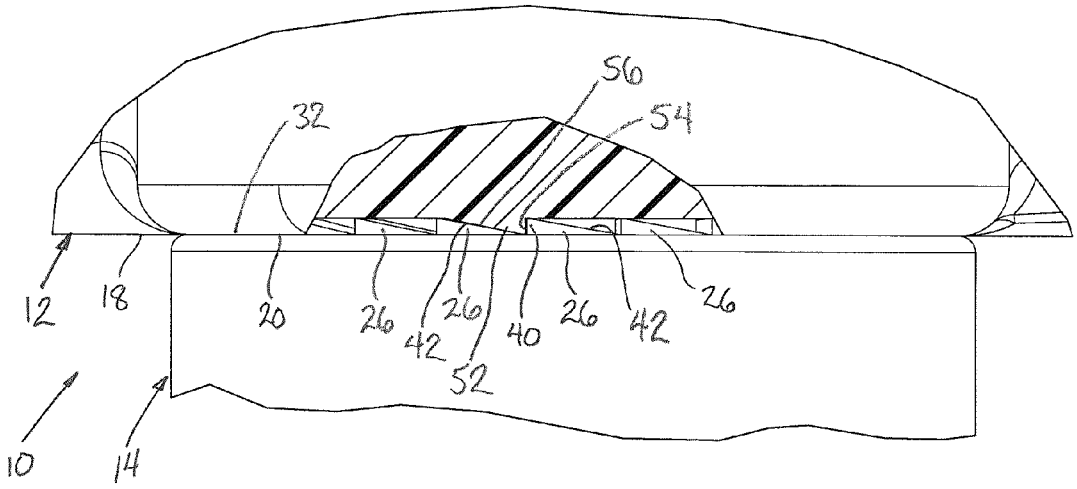
FIG. 4 is an enlarged, fragmentary view of a support foot coupled to a support area of a container in partial vertical cross-section taken along line 4-4 of FIG. 3 to show the interlocking engagement of the array of support feet with one of the notches of the support ring of the support area.
Figure 5:
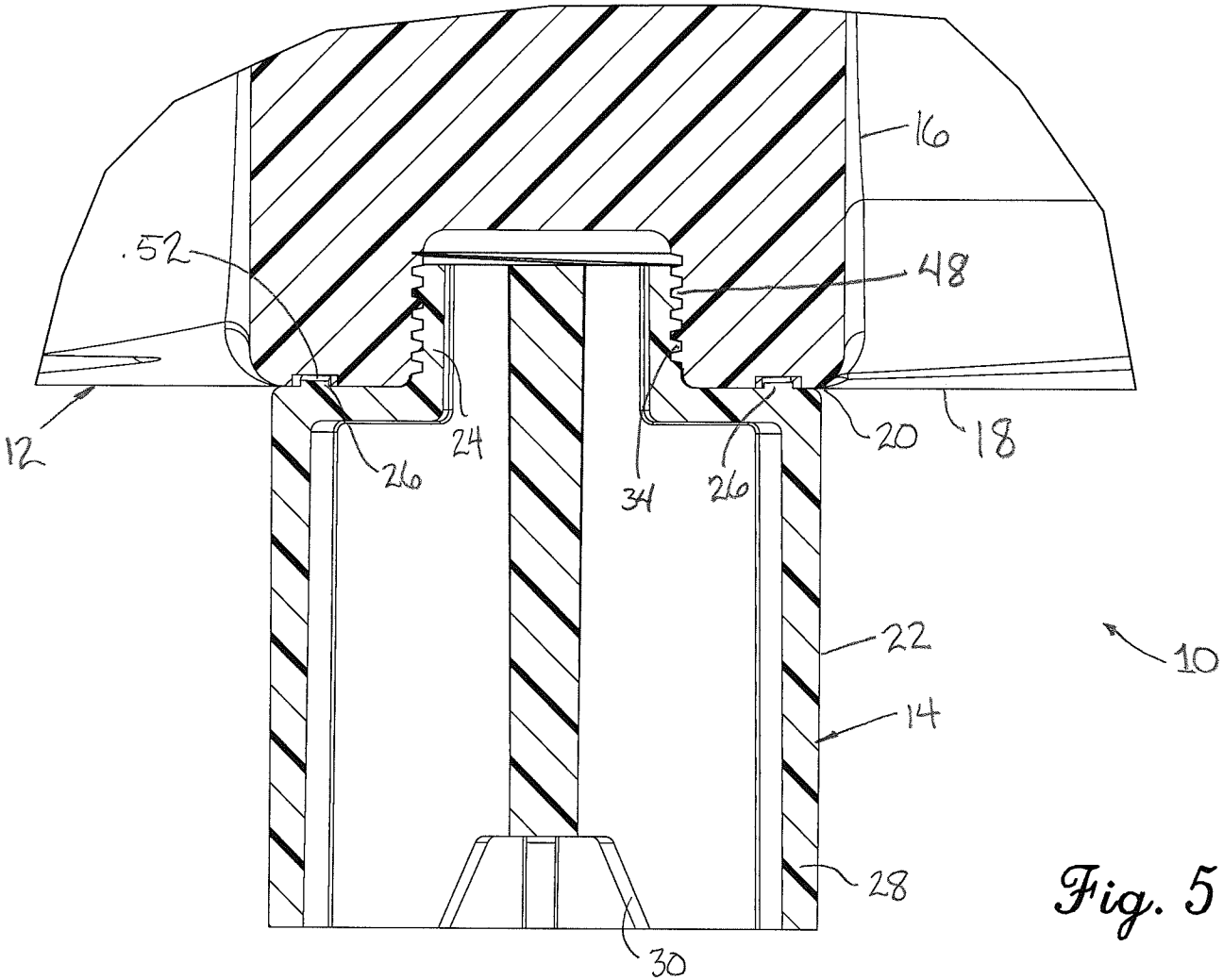
FIG. 5 is an enlarged vertical cross-sectional view taken along line 5-5 of FIG. 3 to show the threaded engagement of a helical thread of the connector with the threaded receiver of one of the support areas of the container, and the support foot includes an annular flat supporting surface opposed and in engagement with a flat annular bottom surface of the support area.
Figure 7:
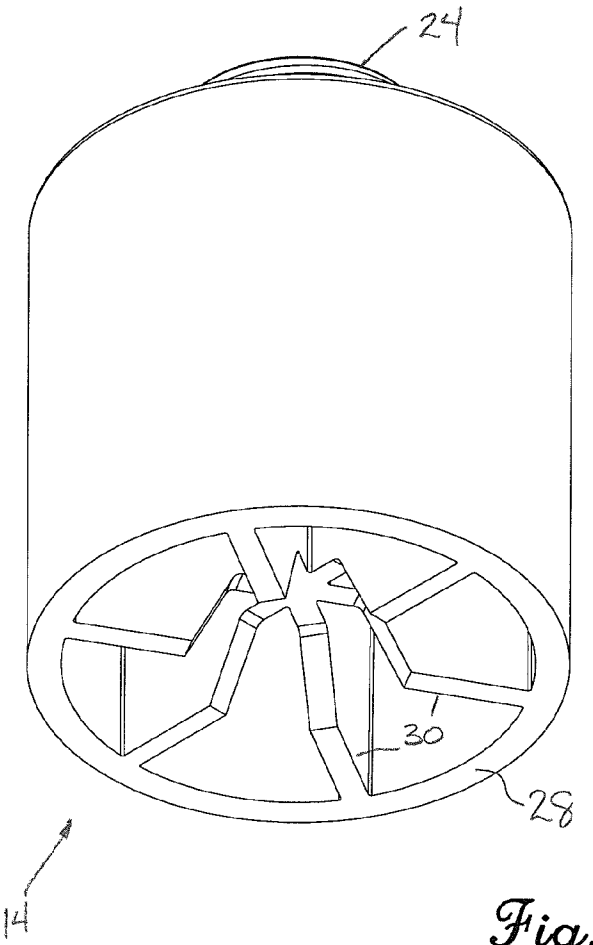
FIG. 7 is an enlarged lower isometric view of the support foot of FIG. 6, showing the radially inwardly extending intersecting ribs.

The support surface 20 of the container 12 is preferably complementally configured to receive and mount a support foot 14 thereon. The support surface 20, as best seen in FIG. 2, includes a threaded receiver 48, which is preferably internally threaded with a helical flight complemental to the helical thread 34. An annular, flat bottom surface 50 which preferably lies in a substantially horizontal plane in normal use surrounds the threaded receiver 48. The annular, flat bottom surface 50 is complementally configured to lie opposite and on top of the flat, annular support surface 46. At least one and preferably a plurality of downwardly extending notches 52 is spaced radially outwardly from the threaded receiver 48. Each notch 52 preferably has a downwardly extending, upright end surface 54 and a sloped surface 56 which converge or intersect at an edge 58. The upright end surface 54 preferably lies along a vertical plane extending outwardly from the center of the threaded receiver 48. The sloped surface 56 is preferably sloped complemental to and opposite the sloped wall 42 of the teeth 26. That is, as seen in FIG. 4, the sloped surface 56 extends downwardly toward the edge 58 in the direction of rotation of the support foot 14 relative to the container 12. The notches 52 are preferably arranged in a generally circular spaced-apart pattern to provided a locking ring 60 as shown in FIG. 2.

In use, a plurality of support feet 14 corresponding to the number of support areas 20 of the container 12 are provided. The connector 24 of each support foot 14 is inserted into the corresponding threaded receiver 48 such that the helical thread 34 mates with and engages the helical flight of the threaded receiver 48 and the support foot 14 is then rotated until the teeth 26 come into engagement with the support area 20. Because the sloped surface 56 is complemental and opposite the sloped wall 46, and because the notches 52 and teeth 26 are preferably of synthetic resin and thus slightly yield, the support foot 14 may be further rotated and tightened. Here, the peak 44 of the teeth 26 should engage the support area 20 of the container 12 and thus "dig in" to the synthetic resin to resist reverse rotation. Moreover, where the connector has a right hand helical thread 34, further clockwise rotation of the support foot 14 should result in a locking condition as shown in FIG. 4, with the flat annular bottom surface 50 resting on and supported by the flat, annular support surface 46 and with the upright end wall 40 of one of the teeth 26 parallel to and opposite the upright end surface 54 of one of the notches 52. When the upright end wall 40 is thus opposed to the upright end surface 54, reverse (here counterclockwise) rotation of the support foot 14 is prevented. Only by extreme exertion of torque sufficient to break the teeth and notches may the support foot 14 be loosened from this tightened, locked condition.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. A container assembly comprising:

a container configured to hold liquid or particulate matter, said container including four sidewalls and a bottom section cooperatively defining an interior chamber for retaining said liquid or particulate matter therein, said bottom section having four corners and at least four support areas with one support area being located near each corner of said bottom section, each support area including:

a threaded receiver;

a plurality of downwardly extending notches arranged in a circular pattern on a lower surface of said threaded receiver; and a plurality of planar recessed areas between said notches, each notch being spaced apart from adjacent notches by one of said recessed areas; and at least four support feet each coupled to a respective one of said support areas so that said bottom section is supported at each corner by one of said support feet, each support foot including:

a substantially cylindrical body having an upper surface;

a connector extending upwardly from the upper surface and having a sidewall including a helical thread thereon; and a plurality of teeth positioned on and extending upwardly from said upper surface and radially spaced from said connector, said teeth of said support foot being configured to contact said recessed areas of said one of said support areas and engage said downwardly extending notches of said one of said support areas when said support foot is connected to said container such that only some of said teeth of said support foot engage said notches of said one of said support areas.

2. A container assembly as set forth in claim 1, wherein said threaded receivers of said support areas are internally threaded receivers and said helical threads on said sidewalls are external threads complementally configured with the internally threaded receivers.

3. A container assembly as set forth in claim 2, wherein said teeth are unitary with said body on each support foot.

4. A container assembly as set forth in claim 2, wherein said connector is unitary with said body no each support foot.

5. A container assembly as set forth in claim 2, wherein said body, said teeth, and said connector on each support foot are integrally molded of synthetic resin.

6. A container assembly as set forth in claim 1, wherein said downwardly extending notches each include a downwardly extending upright end surface and a sloped surface sloping downwardly to intersect with said upright end surface at an edge.

7. A container assembly as set forth in claim 6, wherein each tooth includes an upright end wall, said upright end surface of each of said downwardly extending notches being opposed to one of said upright end walls when a respective one of said support feet is fully threaded onto one of said threaded receivers.

8. A container assembly as set forth in claim 7, wherein said support areas each include an annular, flat bottom surface positioned radially between said downwardly extending notches and one of said threaded receivers.

9. A container assembly as set forth in claim 8, wherein said support feet each include an array comprising said plurality of said teeth arranged in a circular pattern on said upper surface and an annular, flat support surface on said upper surface positioned radially between said connector and said array, whereby when one of said support feet is threaded onto one of said receivers, said array is positioned opposite said downwardly extending notches and said annular, flat support surface is positioned opposite said annular, flat bottom surface.

10. A container assembly comprising:

a container configured to hold liquid or particulate matter, said container including a number of sidewalls and a bottom section cooperatively defining an interior chamber for retaining said liquid or particulate matter therein, said bottom section having a number of support areas, each support area including:

a threaded receiver;

six downwardly extending notches arranged in a circular pattern on a lower surface of said threaded receiver, each notch having a downwardly extending upright end surface and a sloped surface that converges with the upright end surface at an edge; and six planar recessed areas between said notches, each notch being spaced apart equidistantly from adjacent notches by one of said recessed areas; and a number of support feet each coupled to a respective one of said support areas, each support foot including:

a body having an upper surface and six ribs extending upward through said body;

a connector extending upwardly from the upper surface and having a sidewall including a helical thread thereon, said ribs extending into an interior of said connector; and a plurality of teeth positioned on and extending upwardly from said upper surface and radially spaced from said connector, said teeth of said support foot being configured to contact said recessed areas of said one of said support areas and engage said upright end surfaces of said downwardly extending notches of one of said support areas when said support foot is connected to said container such that only some of said teeth of said support foot engage said upright end surfaces of said notches of said one of said support areas.

* * * * *